United States Patent [19]

Boser et al.

[11] 3,964,410

[45] June 22, 1976

[54] ELASTIC INSERTER FOR A SEWING MACHINE

[76] Inventors: Ronald J. Boser, 19 Branwood Drive, Dix Hills, N.Y. 11746; Gerald Gluckin, 440 E. 57th St., New York, N.Y. 10022

[22] Filed: Jan. 24, 1975

[21] Appl. No.: 543,663

[52] U.S. Cl. ..... 112/121.26
[51] Int. Cl.[2] ..... D05B 23/00
[58] Field of Search..... 112/121.26, 211, 214, 112/130, 129, 121.27

[56] References Cited

UNITED STATES PATENTS

| | | | |
|---|---|---|---|
| 2,153,244 | 4/1939 | Galkin | 112/121.26 |
| 2,901,991 | 9/1959 | Reimer | 112/121.26 |
| 3,515,081 | 6/1970 | Miller | 112/130 |
| 3,616,770 | 11/1971 | Blyther et al. | 112/130 X |

*Primary Examiner*—H. Hampton Hunter
*Attorney, Agent, or Firm*—Bauer, Amer & King

[57] ABSTRACT

An attachment for a sewing machine for inserting a selected length of elastic in a hem formed along a fabric edge, such as for example along the corners of a bed sheet, to thereby contribute to the form-fitting performance of the product.

During sewing attachment of the elastic, it is contacted by a member disposed across its feed path, with the desired result that the elastic expands and is thus sewn in place with a controlled degree of tension. The aforesaid elastic-tensioning member, however, is effectively cleared from the elastic feed path during initial positioning or feed of the elastic to the sewing station by a track member which initially moves with the elastic and makes path-clearing contact with the elastic-tensioning member.

10 Claims, 11 Drawing Figures

ELASTIC INSERTER FOR A SEWING MACHINE

The present invention relates generally to an elastic dispensing device for a sewing machine, and more particularly to a device which effectively inserts the dispensed length of elastic in a hem formed along a fabric edge.

It is already well known in the patent literature, as for example in U.S. Pat. No. 1,857,058, how to feed a closed loop of elastic during the sewing attachment of the same about a garment waist and/or leg opening. Generally, the elastic loop is held in tension or expansion during the sewing interval by being disposed about a support circumscribing a sufficiently large circle to produce the desired tension in the elastic loop. In the application contemplated by the within elastic inserter, a length, rather than a loop, of elastic is fed to the sewing station, thereby rendering inapplicable the aforesaid and all other presently known elastic dispensing and feeding devices for sewing machines.

The restricted use of known elastic inserters to elastic loops is due undoubtedly in part to the inability to effectively feed the elastic, when it is in elongated form or lengths, to the sewing station under proper tension or expansion. To impart tension to the elastic, requires making contact with it to slow its speed of feed movement, thus expanding the elastomeric material of the strip or length. However, said contact established with the elastic for tensioning purposes, is an obvious obstacle to initially feeding the elastic from its supply source into the sewing station for attachment to the fabric.

Broadly, it is an object to provide an improved elastic inserter for a sewing machine overcoming the foregoing and other shortcomings of the prior art. Specfically, it is an object to provide an elastic inserter which effectively initially establishes a feed path between the elastic supply and sewing station, and during subsequent feed movement of the elastic along said path imposes a speed differential between it and fabric feeding into the sewing to thereby cause tension or expansion of the elastic length during sewing attachment of it to the fabric. Among other noteworthy aspects of its mode of operation, the within elastic inserter also advantageously prepares the inserted end of each elastic length so as to facilitate its smooth change in direction along its feed path to that of the fabric feed path.

A sewing machine elastic inserter demonstrating objects and advantages of the present invention includes a body defining an elastic feed path having an elastic input and exit at opposite ends thereof. An elastic source of supply is located adjacent the input end of said body, and a first stationary track member for said elastic is located adjacent the exit end of the body. A second track member disposed in enclosing relation about the elastic is operatively arranged for reciprocating sliding movement on the body between a starting position spaced from the stationary track member and an operative position in contact with it wherein the track member cooperates to form a continuous track for said elastic from its supply source to the sewing station. Also provided is an elastic-tensioning member pivotally mounted adjacent the exit end of said body so as to extend across both the elastic feed path and the path of sliding movement of the second track member. As a consequence, the elastic-tensioning member is adapted to make contact with the elastic during feeding movement thereof so as to induce tension in said elastic. However, prior to this, it is adapted to be lifted out of contact with the elastic incident to abutting contact being established with it by the second track member during the tracking of the second track member into its operative position adjacent the first track member.

The above brief description, as well as further objects, features and advantages of the present invention, will be more fully appreciated by reference ot the following detailed description of a presently preferred, but nonetheless illustrative embodiment in accordance with the present invention, when taken in conjunction with the accompanying drawings, wherein.

Figure 7:
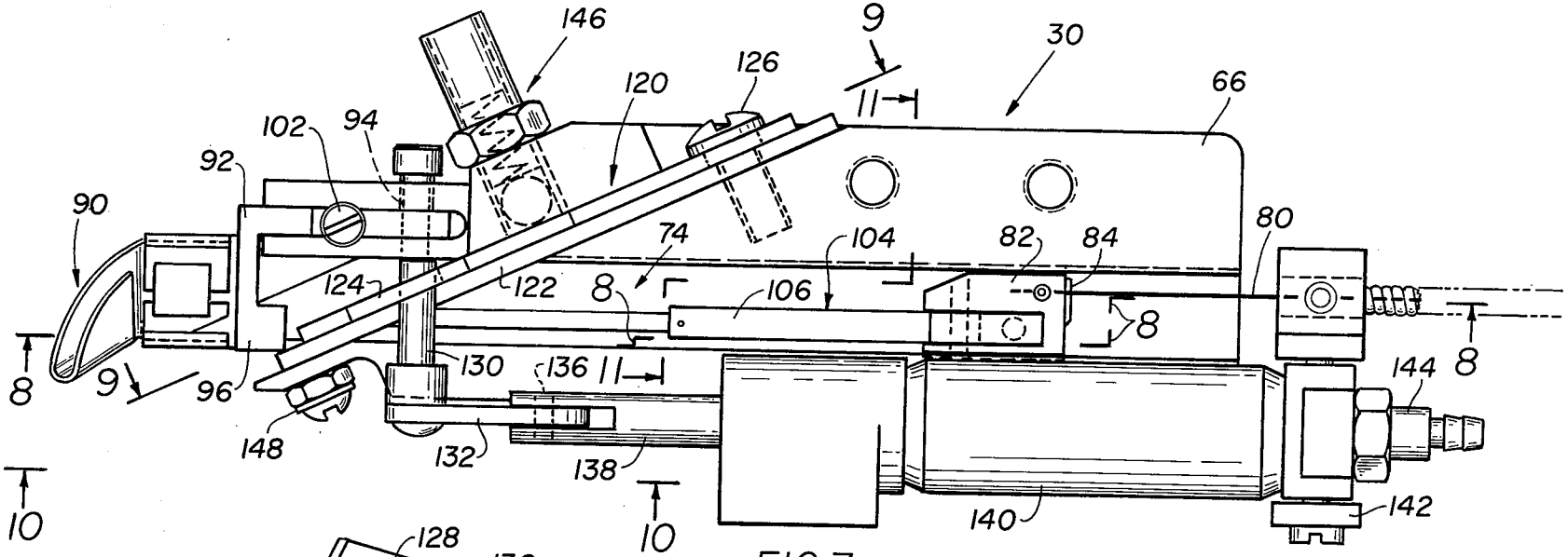
Figure 8:
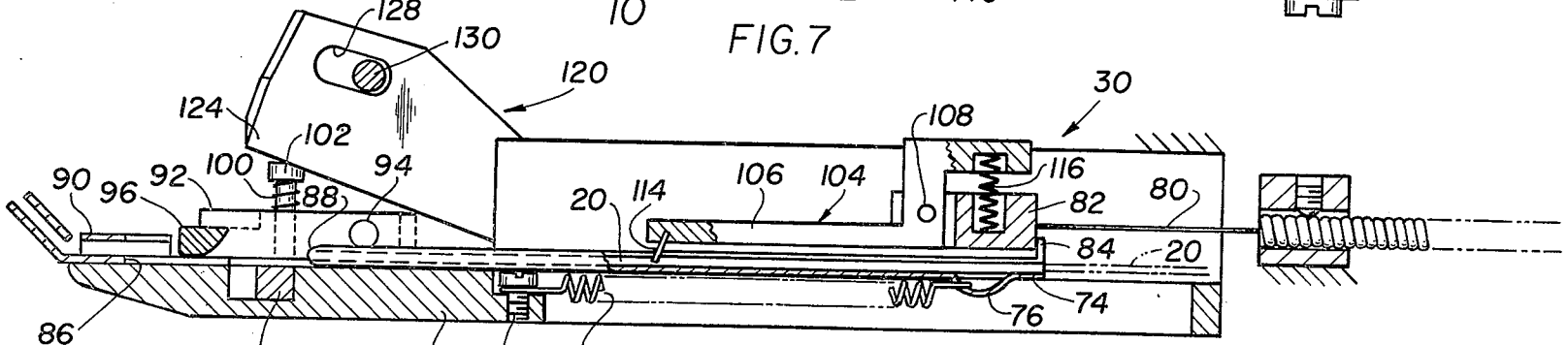
Figure 10:
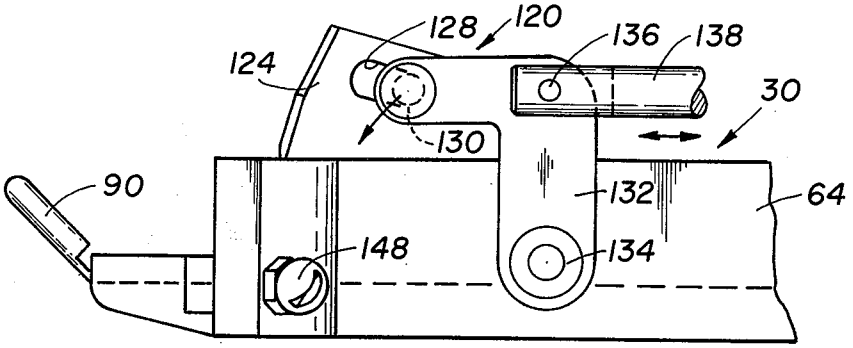
Figure 9:
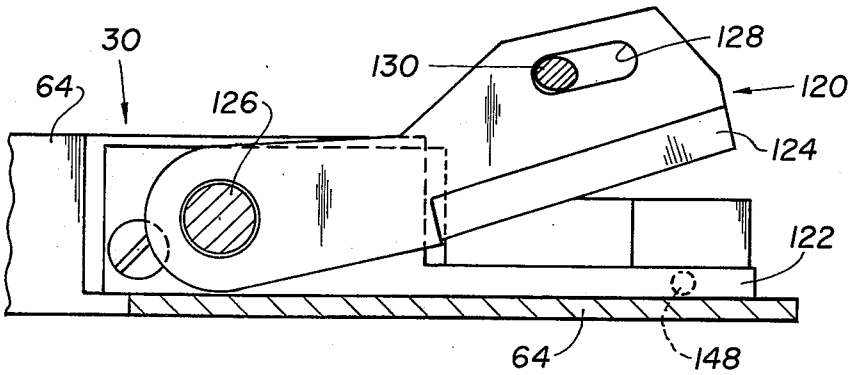
Figure 11:
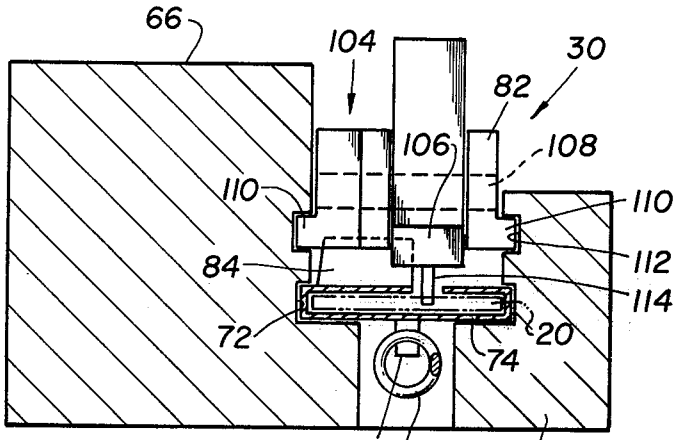

The remaining FIGS. 7–11 relate to the structural details of the elastic inserter hereof. Specifically, FIG. 7 is a plan view of the inserter;

FIG. 8 is a side elevational view, in section taken along 8—8 of FIG. 7, illustrating structural details thereof, particularly of the structure facilitating feed movement of the elastic to the sewing station;

FIGS. 9 and 10 illustrate operation of the cutting device which severs the inserted length of elastic from the supply length thereof. Specifically, FIG. 9 is a front elevational view, in section taken on line 9—9 of FIG. 7, illustrating structural details of the knife, and FIG. 10 is similarly a side elevational view of the knife, but as seen from an opposite direction, as indicated by the arrows 10—10 of FIG. 7; and FIG. 11 is a front elevational view, in section taken on line 11—11 of FIG. 7, illustrating further structural details of the track members which contribute to feed movement of the elastic through the inserter hereof.

Figure 1:
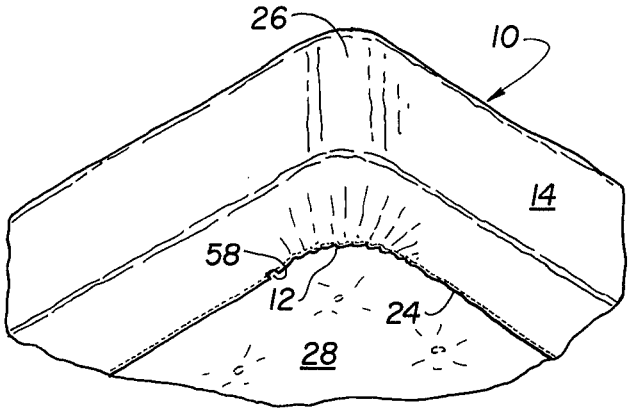
FIG. 1 is a partial perspective view of a form-fitting bed sheet sewn using an elastic inserter according to the present invention.
Figure 2:
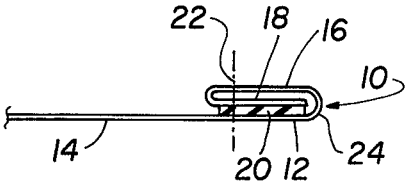
FIG. 2 is a side elevational view, on an enlarged scale, showing the positioning of the elastic along a hemmed edge of the bed sheet of FIG. 1.

FIGS. 1 and 2 demonstrate product aspects of a form-fitting bed sheet 10 which is advantageously produced using the elastic inserter according to the present invention, the structural features and mode of operation of which will soon be described in detail. Unlike apparatus and devices which are already known in the patent literature, as for example, in U.S. Pat. No. 1,857,058, the within elastic inserter is not confined in its use to inserting or positioning a closed loop of elastic along a cooperating circular fabric edge, such as is involved in elasticizing a leg or waist opening of a garment. Rather, as illustrated in FIGS. 1 and 2, the within elastic inserter can be effectively and advantageously used in elasticizing the length portion 12 of the corner construction of the fabric bed sheet 10. As best illustrated in FIG. 2, the elasticized length portion 12 consists specifically of the fabric body 14 of the bed sheet 10 having the characteristic folds 16, 18 of a hem construction, and a selected length of elastic 20 positioned, not in the enclosure formed between the folds 16 and 18, but rather between the fold 18 and fabric body 14, as illustrated in FIG. 2. The elastic 20, which will be understood to be under tension when inserted in its FIG. 2 operative position, is held in place by the attaching seam 22. Thus, in the relaxed condition of elastic 20 it effectively reduces the size of the opening bounded by the fabric edge 24 and, in a well understood manner, thus contributes to a form-fitting capability for the bed sheet 10, particularly at each of its corner constructions 26.

From the foregoing, it should be readily appreciated that not only is a selected length of elastic 20 inserted along the corner edge 12, but that the leading and trailing ends of the elastic 20 are not joined to each other. In this important respect, the inserted elastic 20 is readily distinguishable from a closed loop of elastic which is typically used to elasticize a garment leg opening or a garment waist opening. In the insertion and placement of the said elastic length 20, it is, of course, necessary to place the elastic under tension so that in its relaxed state it performs its function of reducing the opening bounded by fabric edge 24, for otherwise the elastic would serve no useful function in the proper fitting of the bed sheet 10 over its cooperating mattress 28. The application of tension to the inserted elastic length 20 obviously cannot be achieved using the technique applicable for closed loops of elastic with which, for proper tensioning during sewing attachment, it is merely required to place the elastic on supporting structure which holds the elastic loop in a circular size which produces the requisite tension in the elastic. With a length of elastic, such as is involved herein, sewing attachment thereof must be achieved against a suitable drag which tensions the elastic. However, the drag applied against the elastic contemplates the use of a member which contacts the elastic during its feeding movement and which therefore is positioned in the elastic feed path. This position, however, while effective for applying tension to the elastic interferes with the feed movement from its source of supply to the sewing station. The within elastic inserter solves this problem in the feeding and sewing attachment of the length of elastic, as well as contributing in other respects in a noteworthy manner to the automated production of elasticized fabric edges for a wide range of products, as will now be more particularly described.

Figure 3:
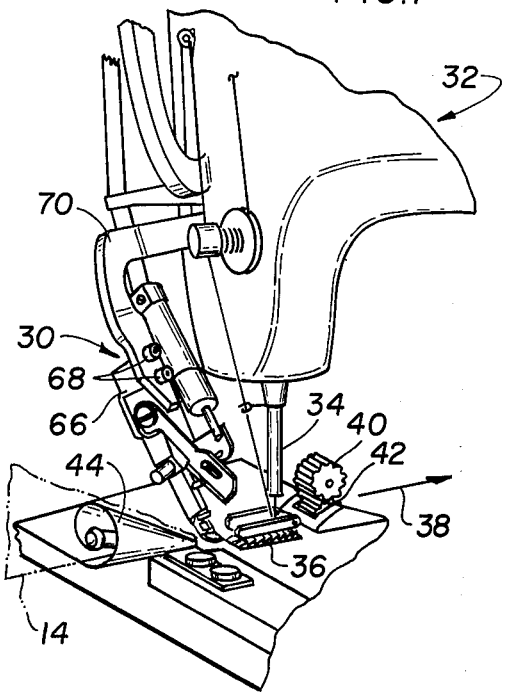
FIG. 3 is a perspective view illustrating the position of the inserter hereof in relation to a hemming device and sewing machine.

As best illustrated in FIG. 3, the within elastic inserter, generally designated 30, is intended to be used as an attachment for a sewing machine 32 having a conventional vertically reciprocating sewing needle 34 and feed dogs 36, as well as other conventional structure. However, the needle and feed dogs 34, 36 are the primary components which define a sewing station for the sewing machine, feed dogs 36 further being instrumental in urging the work through feed movement, such as the bed sheet fabric 14 along a fabric feed path 38 for application thereto of stitch constructions applied or deposited by the sewing needle 34. With a fabric product as large as the previously noted bed sheet 10, it is not uncommon to employ a cooperating pair of pull rollers 40, 42 to assist in urging the fabric 14 through feed movement along the feed path 38.

As already noted in connection with FIG. 2, the inserted elastic 20 exiting from the inserter 30 is positioned in an out-of-view position between the body of the fabric 14 and the folded portions of a hem 16, 18 which is utilized to provide a finished appearance along the fabric edge 24. To provide the hem folds 16, 18 in the fabric, use is made of a conventional hemming scroll or device 44 located in advance of the sewing machine sewing station 34, 36 and adjacent elastic inserter 30.

Figure 4:
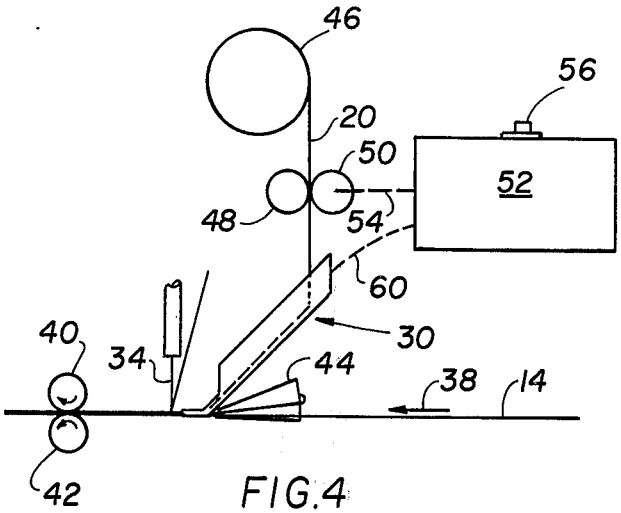
FIG. 4 is a diagramatic view illustrating the cooperative relation between the elastic inserter hereof and the sewing machine.
Figure 5:
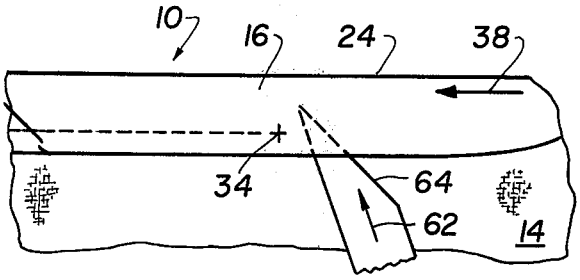
FIGS. 5 and 6 are plan views illustrating, in sequence, the manner in which elastic is inserted in the hem preparatory to sewing attachment along the fabric edge.
Figure 6:
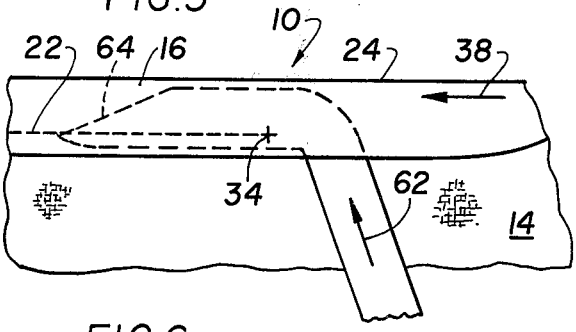

Reference should now be made to FIGS. 4–6 which diagramatically illustrate the positioning of the elastic 20 along the fabric edge 24, in which it is further advantageously masked from view by the hem folds 16, 18. Specifically the elastic 20 is put up in a supply roll 46 from which it is fed between length-metering rollers 48 and 50 to the inserter 30. A timer control 52 is operatively connected, by appropriate circuitry 54, to control pay-out operation of the rollers 48 and 50. It is this operation of the rollers 48 and 50 which provides a selected length of elastic 20 for insertion along the fabric edge 24, said length of elastic being determined by the duration of operation of the constant speed metering rollers 48 and 50. Operation of the timer control 52 can be initiated by a signal from the operator produced by the manual actuation of the switch 56, or it can occur automatically as a result of the pulsing of the timer control 52 by a photoelectric cell or other sensor encountering a control cut-out, such as cut-out 58 (see FIG. 1) provided along the fabric edge 24. In either case, timer control 52 operates in a well understood manner to supply a selected length of the elastic 20 to the inserter 30.

Timer control 52 is also operatively connected, as by appropriate circuitry 60, to the inserter 30, to initiate and control the sequence of the operations thereof. That is, it will be understood that after the selected length of the elastic 20 in unwound from the supply roll 46, timer 52 initiates operation of the inserter 30 so that said selected length of elastic 20 is inserted beneath the hem 16, 18 and along the fabric edge 24. To this end, and as best illustrated in FIG. 4, the fabric 14 is fed through the hemming device 44 which results in the hem folds 16, 18 and then, as best illustrated in FIGS. 5 and 6, the elastic 20 is fed beneath these hem folds at a point just prior to the hemmed fabric 14 reaching the sewing machine sewing station, represented by the sewing needle location 34 in FIGS. 5 and 6.

As illustrated in FIG. 5, the feed path for the elastic 20, represented by the reference numeral 62, is oriented transversely of the fabric feed path 38. In a preferred working embodiment, the angle circumscribed between the feed paths 38 and 62 is approximately 80°, but it will be understood that it is not limited to this specific angular ralationship. The leading edge of the inserted elastic length 20, designated 64, is cut at a significant angle, as illustrated, thereby considerably reducing the bulk or body of the leading edge 64. As a result, the elastic leading edge 64 is more easily and readily able to be urged through the change in direction required in converting from the feed movement path 62 to the feed movement path 38.

As best indicated in FIG. 6, the movement of the elastic 20 past the sewing station 34, and in its inserted position in the enclosure provided by the hem construction 16 along the fabric edge 24, results in the elastic being maintained in its position as a result of the sewing attachment thereof to the fabric body 14 by the seam 22. It is also important to note and understand that at sewing station 34, the feed dogs 36 and/or pull rollers 40, 42 which provide feed movement 38 to the bed sheet 10 are then effective in urging the elastic 20 through its feed movement 62, since the attaching seam 22 must of necessity result in simultaneous feed movement of the elastic 20 with the fabric 14 along the feed path 38. The referred to simultaneous movement theoretically should result in feed movement 62 of the elastic 20 at the same speed as feed movement 38 of the fabric 14. However, it is one of the significant contributions of the present invention to establish a differential between these feed movements and, in this manner, to impart tension, and thus expansion, to the elastic 20 during sewing attachment 22 along the fabric edge 24. That is, in a manner which will soon be described in detail, feed movement 62 of the elastic 20 during a sewing interval and production of the elasticized length portion 12 is purposely slowed to an extent below feed movement 38, and this obviously causes expansion in the elastic 20. The subsequent relaxation of the elastic 20 naturally results in its contraction and the gathering of the fabric 14 along the elasticized length portion 12, thus significantly contributing to the form-fitting performance of the bed sheet 10.

Reference is now made to FIGS. 7–11 which illustrate in detail a preferred embodiment, and its mode of operation, of the within elastic inserter 30. Inserter 30 includes an elongated body 64 which in part is comprised of a block 66 which, as may best be appreciated by examination of FIGS. 3 and 7, is utilized for establishing a bolted connection, as at 68, between the inserter 30 and a bracket 70 of the sewing machine 10, which results in an operative position for the inserter 30 which is angularly oriented at approximately 70 degrees in relation to the horizontal orientation of the fabric 14 as it is fed into the sewing station 34. Mounted for reciprocating sliding movement in a tracking groove 72 machined in body 64 is a movable track member 74 for the inserted elastic length 20, all as is best illustrated particularly in the cross sectional view of FIG. 11. It is particularly to be noted that track member 74 is in encircling relation about the elastic 20, thereby serving to define an internal tracking channel for the elastic 20 while said member 74 operates in an external tracking channel 72, both said internal and external tracking channels being oriented to provide the previously referred to feed path 62 for the elastic 20.

As best illustrated in FIG. 8, track member 74 has a depending loop 76, and body 64 a threaded member 78 serving as an anchor for one end of a helical tension spring 81 connected therebetween and, as a result, providing urgency for propelling the track member 74 from its ready position as illustrated in FIG. 8 along elastic feed path 62 in the direction of the sewing station 34. This feed movement of track member 74 is initially restrained or prevented by the holding action of a cable 80 connected to block 82 which, in turn, is engaged by an upturned projection 84 on track member 74. Thus, so long as block 82 is held against movement, so is track member 74.

After pay-out of the elastic 20 as previously described, the first step in the mode of operation of the inserter 30 is the release of track member 74 for feed movement 62, the same being achieved by the movement of the push cable 80 in the direction 62. This directional movement of cable 80 results in a similar directional movement of tracking member 74 under the urgency of the tension spring 80. Simultaneously there is also, of course, movement of the inserted elastic length 20 that is confined within the tracking member 74 in the direction of the sewing station 34. This initial tracking movement of tracking member 74 occurs until abutment, as at 86, between the forward end 88 of track member 74 and a stationary track or length portion 90 which is mounted on the body 64 at the end thereof from which the elastic 20 exits from the inserter 30. As illustrated, track member 90 has an appropriate angular orientation for smoothly feeding the vertically angularly oriented elastic 20 into the horizontal plane of the work or sewing station 34.

In moving from its FIG. 8 ready position to its operative position, as just described, the tracking members 74 and 90 cooperate with each other to form a continuous track to facilitate the feeding movement 62 of the elastic 20 from its supply source 46 to the sewing station 34.

During said movement, the tracking member 74 also performs a significant function in regard to the subsequent tensioning of the elastic 20. Specifically, adjacent the stationary track 90 is an elastic-tensioning member including an L-shaped body 92 pivotally mounted, as at 94, for pivotal traverses which position its leg 96, which is disposed across the path of movement of the track member 74, either directly in said path, or in a clearance position in relation thereto. Leg 96, as best shown in FIG. 8, includes a camming surface 98 in facing relation to the tracking member forward end 88. Thus, when tracking member 74 closes against the stationary track 90, the elastic-tensioning member 92 is cammed into a clearance position, or lifted about the pivot 94. This lifting movement is against a spring urgency resulting from contraction or compression of spring 100. In an obvious manner, adjustment in the spring urgency of spring 100 can be made by threadable adjustment of threaded member 102.

From what has been described, it should be readily appreciated that when track member 74 is separated from track member 90, as occurs when it is withdrawn back into its FIG. 8 ready position, that this releases the elastic-tensioning member 92 for a pivotal traverse under the urgency of spring 100 in the direction of the inserter body 64. This, of course, establishes contact of the leg 96 with the elastic 20 resulting in the exertion of a drag on the elastic 20, and consequently in the expansion of elastic 20 during its sewing attachment along the bed sheet edge 12.

Prior to the aforesaid sewing attachment of the elastic 20 to the fabric 14, it is of course necessary that the elastic 20 be positioned in the hem 16, 18 along the fabric edge 24, and that said hem construction and elastic be projected into the sewing station 34 for penetration thereat by the sewing machine needle. This required feed movement 62 in the elastic 20 was previously described in connection specifically with FIGS. 5 and 6, wherein the elastic leading edge 64 is projected out of the stationary track 90 into the fabric hem 16 and through the change of direction from feed direction 62 to feed direction 38. This feed movement in the elastic 20 is achieved, in accordance with the present invention, using an elastic-pusher, generally designated 104. Pusher 104 includes an extending arm 106 pivotally connected, as at 108, at the forward end of block 82 which, as indicated previously, is connected to the push cable 80 and moves simultaneously with track member 74 during its tracking movement into abutment with the stationary track 90. After said abutment, and thus the establishment of a continuous track formed by the track members 74 and 90, push cable 80 is urged for a further distance in the direction 62, thus resulting in sliding movement of the pusher 104 along the track member 74. As best shown in FIG. 11, tracking projections 110 on opposite sides of the block 82 cooperate with guide grooves 112 in the inserter body 64 to maintain tracking movement in the pusher 104 which is aligned along the feed path 62. At the free end of arm 106 there is an angularly oriented pin 114, the pointed end of which is pushed into engagement with the elastic 20 by a spring 116 strategically located on the opposite side of the pivot 108.

Feed movement of the inserted elastic length 20 occurs as follows. Initially, as already noted, timer 52 pays out a supply length of the elastic 20. Next, push cable 80 is released causing spring 81 to propel track member 74 along with the pusher 104 in the direction of the stationary track 90, track 74 actually making contact with track 90. During this feed movement, of course, a length of the elastic 20 is moved along its feed path 62 out of the length portion that had previously been payed out from the supply roll 46. After abutting contact of track member 74 with track member 90, pushing cable 80 is urged through further feed movement in the direction 62, thereby resulting in the pusher 104 being urged from its rearward position on the track member 74, as illustrated in FIG. 8, into its forward position in which pin 114 will be understood to be adjacent the forward end 88 of track member 74. As a result of this relative movement of pusher 104 along the track member 74, elastic 20 which is engaged by the pin 114 is simultaneously moved the distance of said relative movement between the components 104 and 74. This extent of movement in the elastic 20 will be understood to be sufficient to project the leading edge 64 of the elastic 20 through the positions of movement depicted in FIGS. 5 and 6. Once the elastic is in its FIG. 6 operative position, it is engaged at the sewing station 34 by the sewing machine needle and the attaching seam 22, which then results has two significant functions. First, it holds the elastic 20 in its operative position within the hem 16. Second, it results in the attached elastic 20 being under the sewing machine feeding apparatus, consisting either of the feed dogs 36 or pull rollers 40, 42, or these components operating together. At this time, therefore, the elastic 20 should theoretically be moving at the feeding speed of the fabric 14. However, at this significant point in the mode of operation of the elastic 20, it is contemplated that push cable 80 will be withdrawn to its FIG. 8 position, in which instance block 82 engages the upstanding projection 84 of the track member 74 and thus causes the withdrawal of the track member 74 from the stationary track member 90. When this occurs, spring 100, as already noted, urges the elastic-tensioning member 92 against the elastic 20 which is being pulled into the sewing station 34 by the sewing machine feed dog 34 and/or pull rollers 40, 42. The drag exerted by the leg 96 on the elastic 20 causes an expansion of the elastomeric material of which strip 20 is fabricated, and accordingly, elastic 20 is incorporated along the fabric edge 24 in a proper condition of tension.

During withdrawal of the pusher 104 it should be apparent that due to the angular orientation of the elastic-engaging pin 114 that this direction of movement readily results in disengagement of the pin 114 from the elastic 20. Facilitating this disengagement is a slight clockwise pivotal traverse in the pusher 104 which is permitted by a corresponding slight contraction in the spring 116.

After a selected length of elastic is permitted to feed into the sewing station 34, the length being determined by any appropriate manner such as by counting the stitches deposited by the sewing needle 34 in the fabric 14, it is necessary to sever the inserted length of elastic 20 from its supply length 46. Further, as already noted, it is advantageous to achieve the severing cut in the elastic 20 at an angular orientation so that the leading edge of the next succeeding length of elastic 20 which is fed to the sewing machine 34 is cut at an angle, as exemplified by the elastic leading edge 64, illustrated in FIGS. 5, 6. This severing cut in the elastic 20 is achieved using a scissor-type cutting device, generally designated 120, which is angularly oriented across the elastic feed path 62 and which operates in the separation existing between the stationary track 90 and the slidable track 74, when the latter is in its retracted position, as illustrated in FIGS. 7, 8. The location of the knife or cutting device 120 relative to the other components of the inserter 30 is best illustrated in the plan view of FIG. 7, whereas the specific structural features thereof are best illustrated in FIGS. 9 and 10. Cutter 120 includes a stationary or fixed blade 122 which cooperates with a pivotally mounted upper blade 124 to produce a shearing cut in the elastic 20. The movable blade 124 is pivotally mounted at one end, as at 126, and at its opposite, or free end, has an elongated slot 128 in which is seated a drive pin 130 extending laterally of a bell crank 132. Crank 132 is pivotally mounted at 134 to the inserter body 64 and is connected, as at 136, to the piston rod 138 of a double acting air cylinder 140. As best shown in FIG. 7, cylinder 140 has one end properly positioned in an appropriate mounting bracket 142, and has appropriate valve connections 144 to a source of pressure air.

Completing the construction of the cutter 120 is spring biasing means 146 (see FIG. 7) for urging movable blade 124 into a vertical plane of operation which is in close shearing relation to the fixed blade 122. Adjustment of the fixed blade 122 in this respect is achieved using the threaded member 148.

From the foregoing description it should be readily appreciated that the inserter 30 is an effective device for feeding select lengths of elastic 20 to the sewing station of a sewing machine and thereby provide elasticized length portions, such as length portion 12, for a wide variety of products, a noteworthy and exemplary one of which is the bed sheet 10.

A latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. In combination, a sewing machine including a sewing needle and feed dogs defining a sewing station, means defining a fabric feed path into said sewing station, a fabric hemming device located along said fabric feed path in advance of said sewing station, and an elastic inserter located adjacent the exit end of said fabric hemming device for inserting elastic into said hem for sewing attachment to the fabric fed into said sewing station, said elastic inserter comprising a supply of elastic, means defining an elastic feed path oriented transversely of said fabric feed path, an elastic-tensioning means disposed along said elastic feed path mounted for movement between movement-resisting contact with said elastic for tensioning the same and a clearance position in relation therewith, a rigid enclosure member about the supply length of elastic movable from a ready position along said elastic feed path simultaneously with said elastic positioned therein through an elastic-feed stroke into abutting contact with said elastic-tensioning means incident to urging said elastic-tensioning means into said clearance position thereof, an elastic-engaging means operable to further urge said elastic through said rigid enclosure member along said feed path to thereby locate the leading edge of said elastic at said sewing station and under the feed control of said feed dogs, and means withdrawing said enclosure member back into said ready position thereof incident to permitting movement-resistant contact of said elastic-tensioning means with said elastic, whereby during subsequent feed movement of said elastic as produced by said feed dogs said elastic is tensioned by said elastic-tensioning means.

2. An elastic inserter for a sewing machine as claimed in claim 1 wherein said means for withdrawing said enclosure member back into said ready position thereof comprises a cable attached to and operatively effective to cause withdrawal of said elastic-engaging means, and a projection on said enclosure member operably effective to engage said elastic-engaging means during said withdrawal thereof, whereby said enclosure member is withdrawn by said cable simultaneously with said elastic-engaging means.

3. An elastic inserter for a sewing machine as claimed in claim 2 including a spring connected to oppose said withdrawal of said enclosure member as caused by said cable, and in said opposite direction to contribute spring urgency propelling said enclosure member through said elastic-feed stroke.

4. An elastic inserter for a sewing machine as claimed in claim 3 wherein said elastic-tensioning means includes a pivotally mounted member disposed across said elastic feed path having a camming surface in facing relation to said enclosure member being urged into abutting relation therewith, whereby said abutment causes a camming of said elastic-tensioning means into said clearance position.

5. An elastic inserter for a sewing machine as claimed in claim 4 including a spring means operatively effective to both oppose said camming movement of said elastic-tensioning means and to selectively urge said elastic-tensioning means in an opposite direction into said movement-resisting contact with said elastic so as to allow regulation of the extent of said resistance provided by said contact.

6. An elastic inserter for a sewing machine as claimed in claim 1 including a cutter angularly disposed in cutting relation across said elastic feed path for producing an angularly oriented leading edge during the severing of said inserted length of elastic from the supply length thereof, to thereby facilitate the positioning of said elastic leading edge into said fabric hem at said sewing station.

7. An elastic inserter for a sewing machine comprising a body defining an elastic feed path having an elastic input and exit at opposite ends thereof, an elastic source of supply located adjacent said input end of said body, a first stationary track member for said elastic adjacent said exit end of said body, a second track member disposed in enclosing relation about said elastic operatively arranged for reciprocating sliding movement on said body between a starting position spaced from said stationary track member and an operative position in contact therewith forming a continuous track for said elastic, an elastic-tensioning member pivotally mounted adjacent said exit end of said body across both said elastic feed path and said path of sliding movement of said second track member, and means for pushing said elastic along said feed path defined by said abutting first and second track member comprising a body member mounted on said second track member for independent sliding movement relative thereto, a pushing cable operatively connected to urge said body member in a feed direction along said second track member after said contact of said second track member with said first track member, and a depending angularly oriented pin on said body member effective to engage said elastic in said feed direction movement of said body member and to automatically disengage therefrom in said opposite direction of movement.

8. A sewing machine elastic inserter as claimed in claim 7 including means for separating said first and second track members, a knife means disposed adjacent said exit end of said elastic inserter body and across said elastic feed path in said separation between said first and second track members, and means for operating said knife after said separation of said track members.

9. A sewing machine elastic inserter as claimed in claim 8 wherein said knife means is disposed angularly across said elastic feed path for producing an angularly oriented leading edge in said elastic during the severing of said inserted length of elastic from the supply length thereof.

10. A sewing machine elastic inserter as claimed in claim 8 including a fabric hemming device located adjacent said elastic inserter for producing a hem in the fabric which is to receive elastic from said elastic inserter.

* * * * *